US012759765B2

(12) United States Patent
Harvey et al.

(10) Patent No.: US 12,759,765 B2
(45) Date of Patent: Oct. 13, 2026

(54) SELF-CLOSING DRUM LIDS WITH CONTROLLED CLOSING RATES

(71) Applicant: New Pig Corporation, Tipton, PA (US)

(72) Inventors: William George Harvey, New Florence, PA (US); Gregory R. Harpster, Pine Grove Mills, PA (US)

(73) Assignee: New Pig Corporation, Tipton, PA (US)

( * ) Notice: Subject to any disclaimer, the term of this patent is extended or adjusted under 35 U.S.C. 154(b) by 82 days.

(21) Appl. No.: 18/812,708

(22) Filed: Aug. 22, 2024

(65) Prior Publication Data

US 2026/0054891 A1 Feb. 26, 2026

(51) Int. Cl.

*B65D 43/26* (2006.01)
*B65D 1/16* (2006.01)
*B65D 43/16* (2006.01)

(52) U.S. Cl.

CPC ..... *B65D 43/26* (2013.01); *B65D 1/16* (2013.01); *B65D 43/163* (2013.01); *B65D 2543/00092* (2013.01)

(58) Field of Classification Search

CPC .... B65D 43/26; B65D 43/265; B65D 43/267; B65F 2001/1661; B65F 1/1623; E05F 3/04

USPC ..... 220/287, 254.5, 827, 345.2, 345.3

See application file for complete search history.

(56) References Cited

U.S. PATENT DOCUMENTS 2,828,176 A * 3/1958 Burgh ..... B65F 7/00 220/908
2,888,162 A 5/1959 Herpich
3,825,215 A * 7/1974 Borglum ..... B65F 1/141 220/264
3,850,336 A 11/1974 Acosta
5,758,937 A * 6/1998 Lammens ..... E05D 15/582 49/386
6,378,249 B1 * 4/2002 Foss ..... B65D 90/66 49/386
8,418,869 B2 4/2013 Yang et al.
8,480,139 B2 7/2013 Starr et al.
9,284,117 B2 3/2016 Guild
9,573,760 B2 2/2017 Guild
2008/0105682 A1 5/2008 Goddard (Continued)

FOREIGN PATENT DOCUMENTS

EP 1508538 A1 2/2025

OTHER PUBLICATIONS

Justrite Product Description, "Drum Cover With Fusible Link for 55 Gallon Drum, Self-Close, Steel, Red—26750".

(Continued)

*Primary Examiner* — Jeffrey R Allen

(74) *Attorney, Agent, or Firm* — Alan G. Towner; Leech Tishman Fuscaldo & Lampl

(57) ABSTRACT

Self-closing drum lids that automatically close at controlled rates are disclosed. When the lid is manually rotated to a fully open position, it automatically begins self closing with a transition from a relatively slow rate that allows a user to add material and/or remove material from the drum without having to hold the lid open by hand. After the slow-closing stage, the lid begins to close at a faster rate until the lid rotates to a fully closed position on the drum. The self-closing drum lids may be attached to a drum via a drum band, and may include a latching mechanism.

25 Claims, 13 Drawing Sheets

(56) References Cited

U.S. PATENT DOCUMENTS

| | | | |
|---|---|---|---|
| 2011/0095027 | A1 | 4/2011 | Starr et al. |
| 2011/0309081 | A1 | 12/2011 | Starr et al. |
| 2017/0292309 | A1 | 10/2017 | Neuman |

OTHER PUBLICATIONS

International Search Report and Written Opinion from corresponding International Application No. PCT/US2025/42896.

* cited by examiner

SELF-CLOSING DRUM LIDS WITH CONTROLLED CLOSING RATES

FIELD OF THE INVENTION

The present invention relates to self-closing drum lids with controlled closing rates.

BACKGROUND INFORMATION

Lids have been used to close containers such as drums used in various industries. Such drums are typically 55 gallon or 30 gallon drums, but can also range, for example, from 5 gallon to 85 gallon drums. Such containers often have top lids that cover and may seal the drum to contain the materials inside.

SUMMARY OF THE INVENTION

Self-closing drum lids of the present invention automatically close at controlled rates. When the lid is manually rotated to a fully open position, it automatically begins self closing with a transition from a relatively slow rate that allows a user to add material and/or remove material from the drum without having to hold the lid open by hand. After the slow-closing stage, the lid begins to close at a faster rate until the lid rotates to a fully closed position on the drum. The self-closing drum lids may be attached to a drum via a drum band that may be adjustable to fit variations of drum diameters. The self-closing lid may include a latching mechanism that engages a corresponding latching mechanism of the drum band.

The self-closing drum lids may include a soft self-closing mechanism with one or more one-way extension dampeners pivotally attached at one end to a lid bracket on the drum and pivotally attached at an opposite end to a dampener bracket that extends downward from the drum band. The extension dampener(s) may provide a physical stop to limit the lid opening, e.g., when the lid is rotated to approximately 85° to 89° from its horizontal closed position. Preventing the lid from opening past 90° keeps its center of gravity off-vertical in order to allow the lid to close naturally by gravity without operator assistance. The extension dampener(s) may offer minimal resistance while manually opening the lid and a higher resistance during self-closing of the lid. Typically, the extension dampener(s) do not assist with the opening of the lid, i.e., they do not apply an opening force against the lid when the lid travels from its closed to its open position.

An aspect of the present invention is to provide a self-closing drum lid comprising a drum lid, a dampening bracket assembly attached to the lid comprising a lid bracket including a radial arm extending radially outward from an outer rim of the drum lid and an upwardly extending vertical arm extending upward from the radial arm, a dampener bracket pivotally attached to the lid bracket extending downward from the radial arm including at least one downwardly extending vertical arm and a base adjacent a bottom end of the at least one downwardly extending vertical arm, and a dampener piston assembly comprising at least one dampener piston having an upper end pivotally attached to the upwardly extending vertical arm of the lid bracket and a lower end pivotally attached adjacent to the base of the dampener bracket. The self-closing drum lid may also include a drum band bracket to which the drum lid is pivotally attached and to which the dampener bracket is fixedly attached.

Another aspect of the present invention is to provide a drum assembly comprising a drum, a drum band attached to the drum comprising a drum band bracket, and a self-closing drum lid pivotally connected to the drum band bracket. The self-closing drum lid comprises a drum lid, a dampening bracket assembly attached to the lid comprising a lid bracket including a radial arm extending radially outward from an outer rim of the drum lid and an upwardly extending vertical arm extending upward from the radial arm, a dampener bracket pivotally attached to the lid bracket and fixedly attached to the drum band bracket extending downward from the radial arm including at least one downwardly extending vertical arm and a base adjacent a bottom end of the at least one downwardly extending vertical arm, and a dampener piston assembly comprising at least one dampener piston having an upper end pivotally attached to the upwardly extending vertical arm of the lid bracket and a lower end pivotally attached adjacent to the base of the dampener bracket.

These and other aspects of the present invention will be more apparent from the following description.

DETAILED DESCRIPTION

An embodiment of the self-closing drum lid may include a lid and band fitted with brackets and one, two or more hydraulic dampeners. The dampener(s) and brackets are configured to control the lid closing speed, e.g., during extension of the hydraulic dampener(s), and may provide little or no resistance when opening of the lid, e.g., compression of the hydraulic dampener(s). The self-closing drum lid may be designed to be opened not more than 90° from horizontal to facilitate gravity initiation of the closing process. A user may open the lid to access the interior of the container and then may let go of the lid. After an initial slack or tolerance period during which the lid may close a few degrees relatively quickly from its fully open position, the lid begins to slowly close. For example, the lid may take approximately 15 to 20 seconds to close to an angle of about 60° or 70° from horizontal, then pass through a transition angle where in the lid begins to close at a faster rate. The slow close period allows the user time to add or remove material from the container without having to hold the lid open. As the lid continues to close, the lid closing speed increases and may travel the remaining 60° to 70° in about 10 seconds. If necessary, additional add/remove time can be obtained by re-lifting the lid to its full open position.

Figure 1:
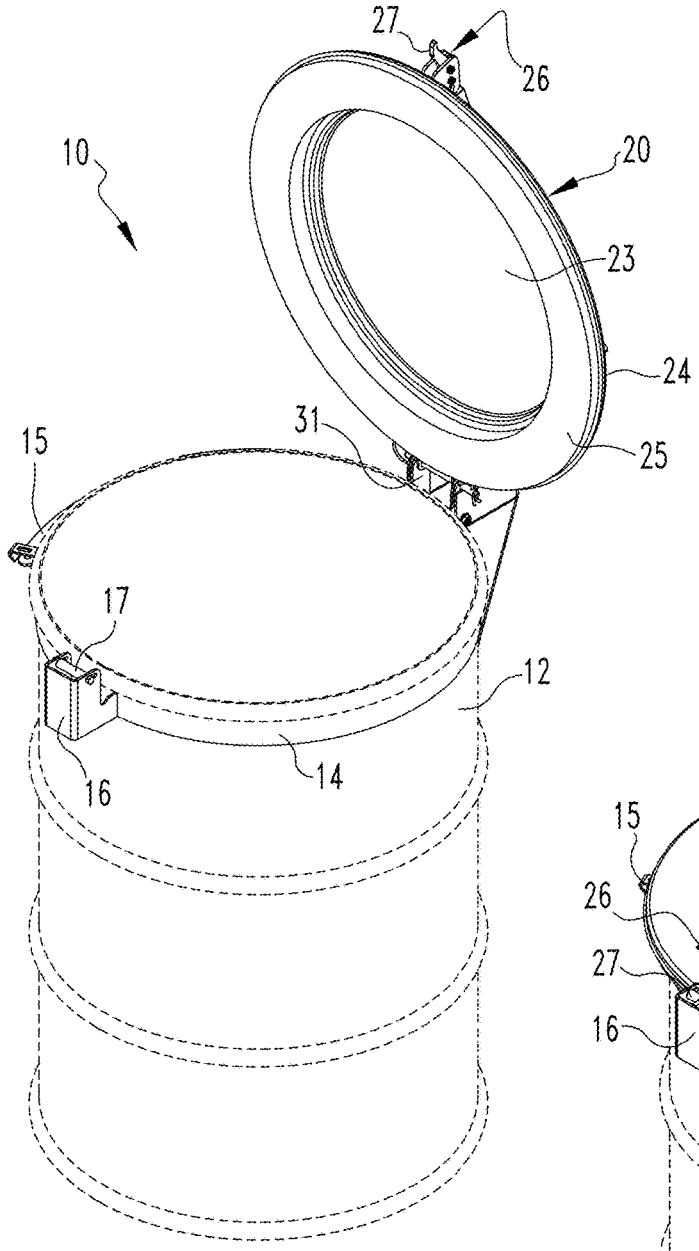
FIGS. 1 and 2 are isometric views of a drum assembly with a self-closing drum lid in an open position and a closed position, respectively.
Figure 2:
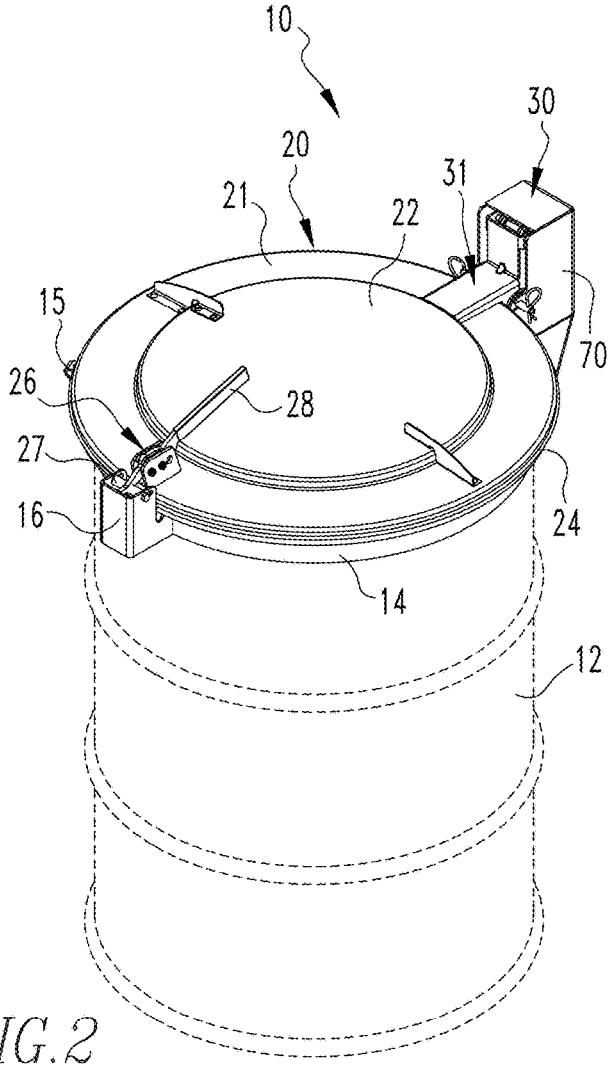
Figure 3:
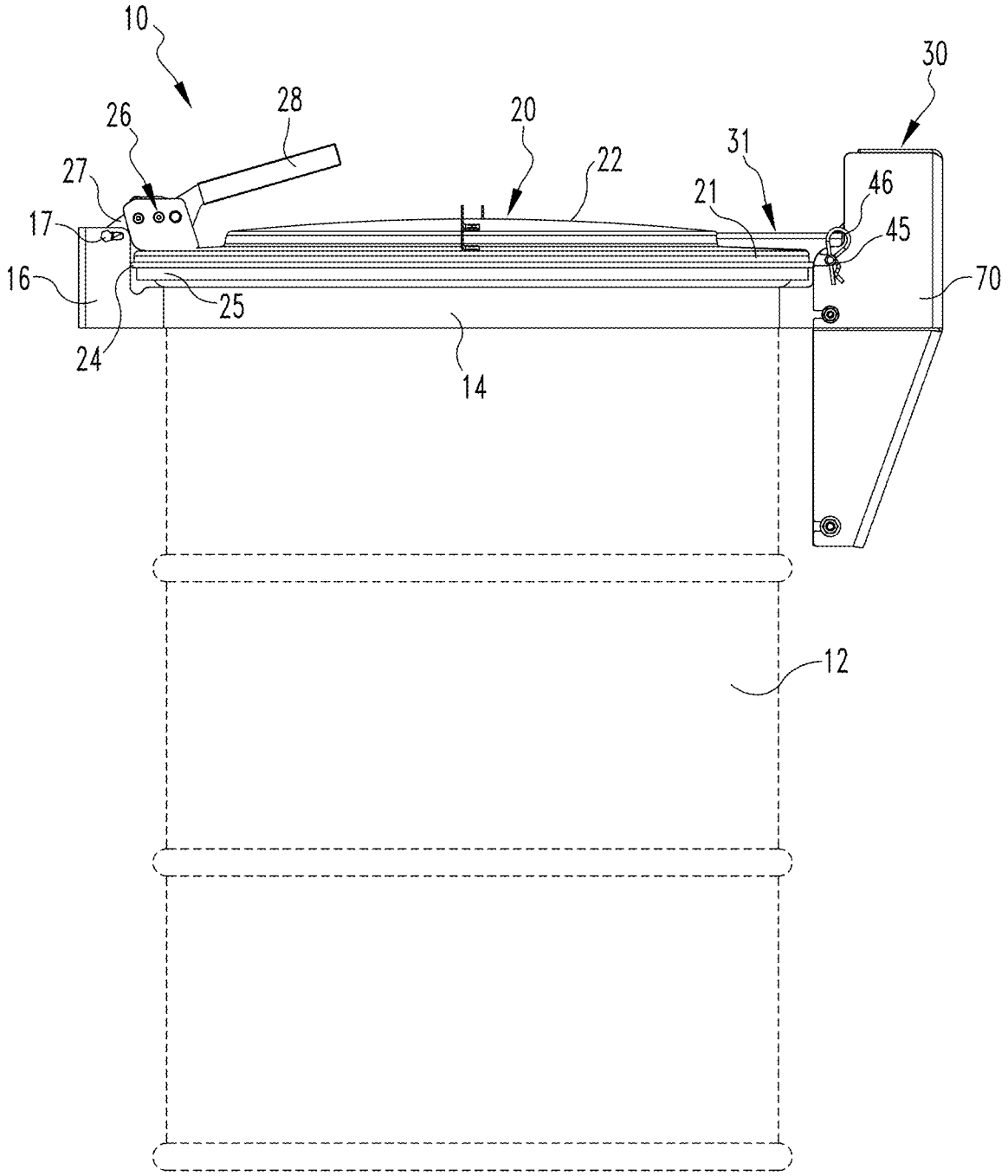
FIG. 3 is a side view of the drum and lid of FIG. 2 in the closed position.
Figure 4:
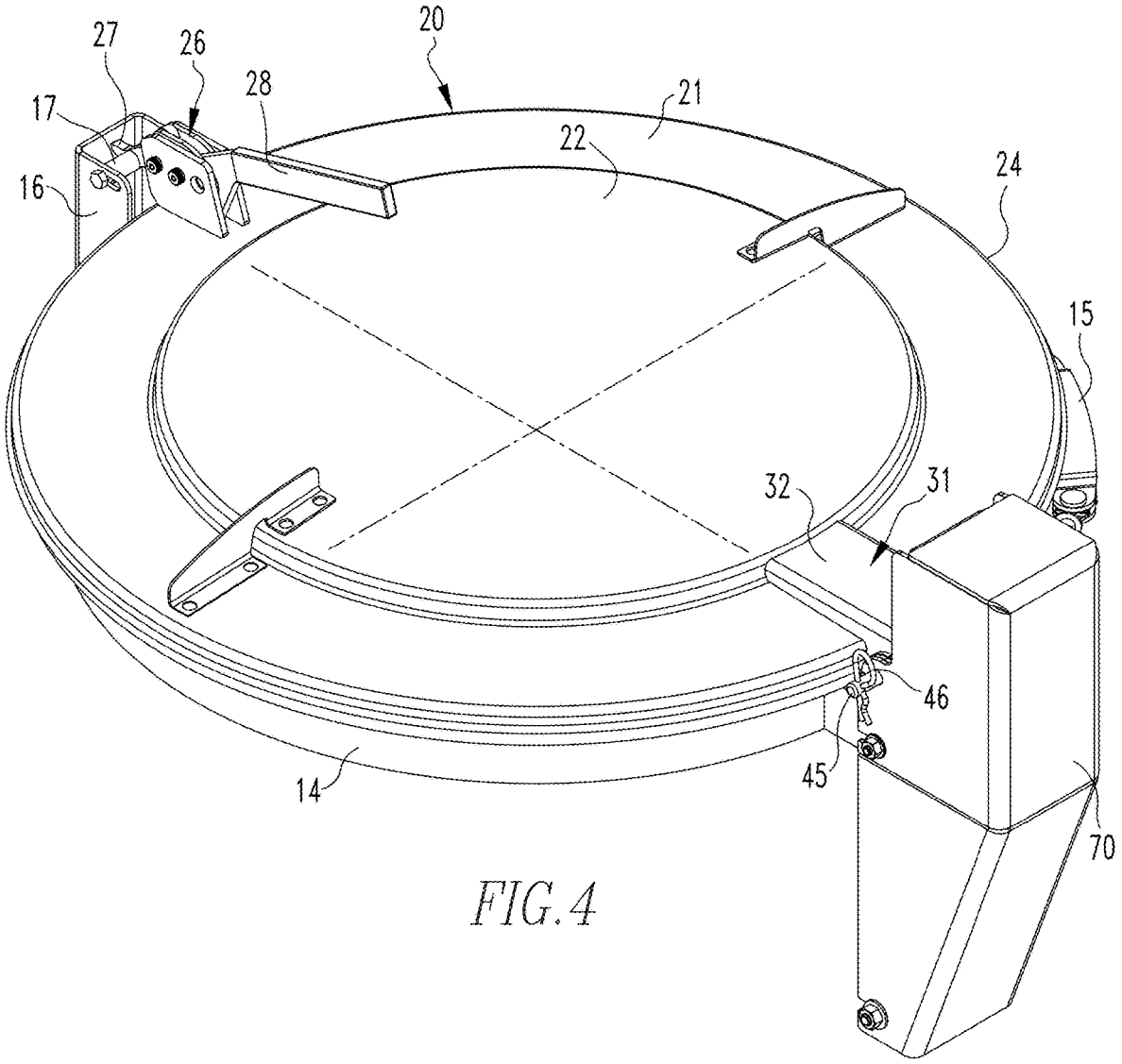
FIGS. 4-7 are isometric, top, side and front views, respectively, of the self-closing drum lid of FIGS. 1-3.
Figure 5:
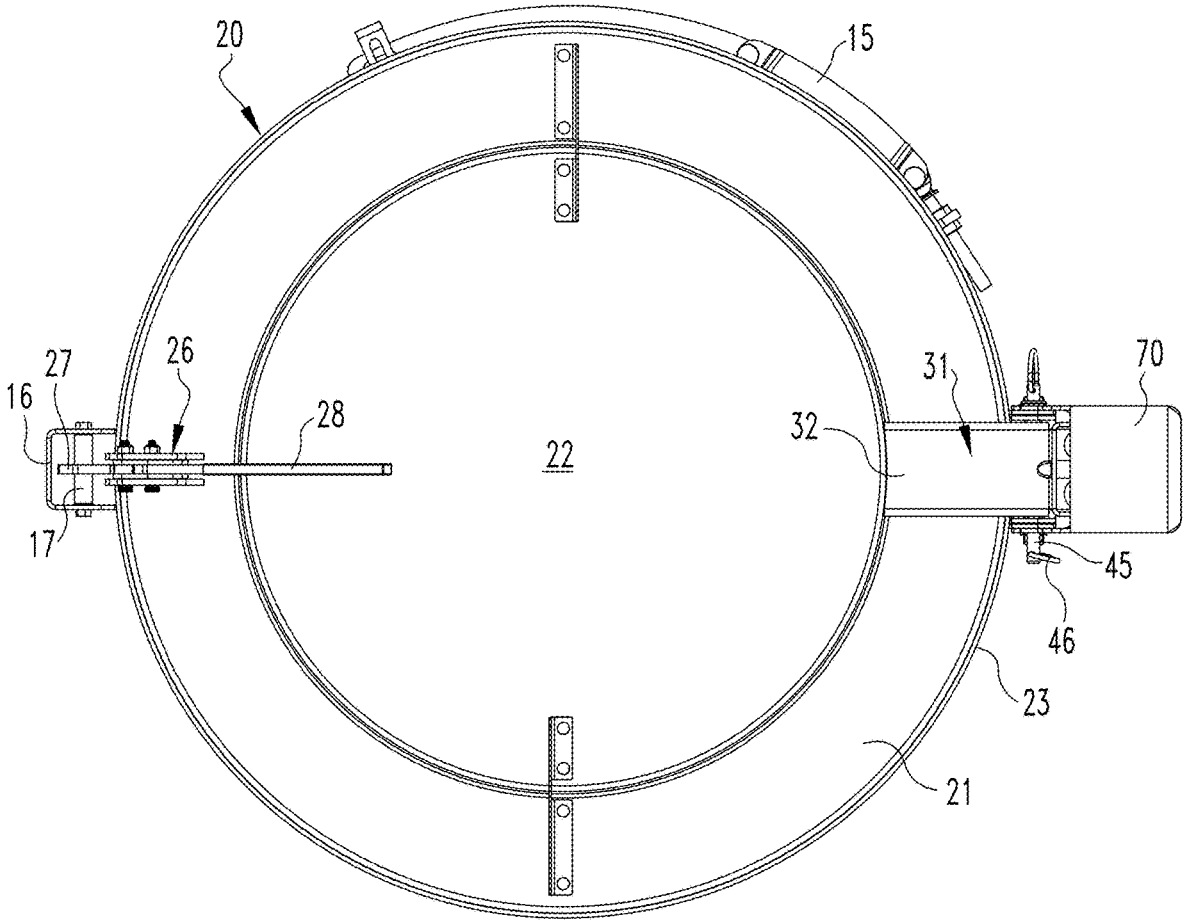
Figure 6:
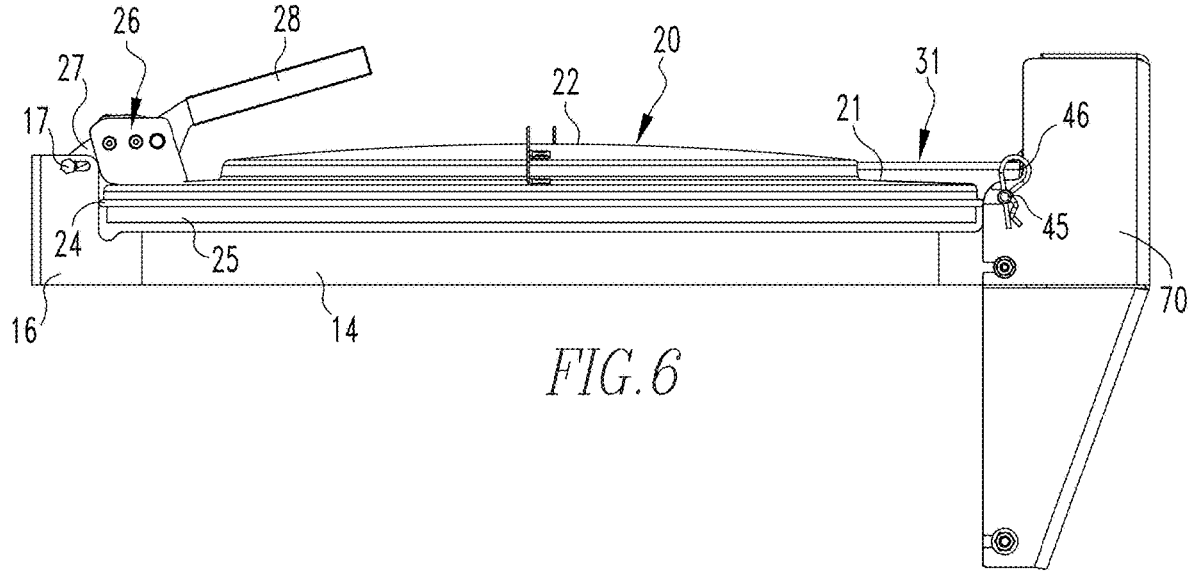
Figure 7:
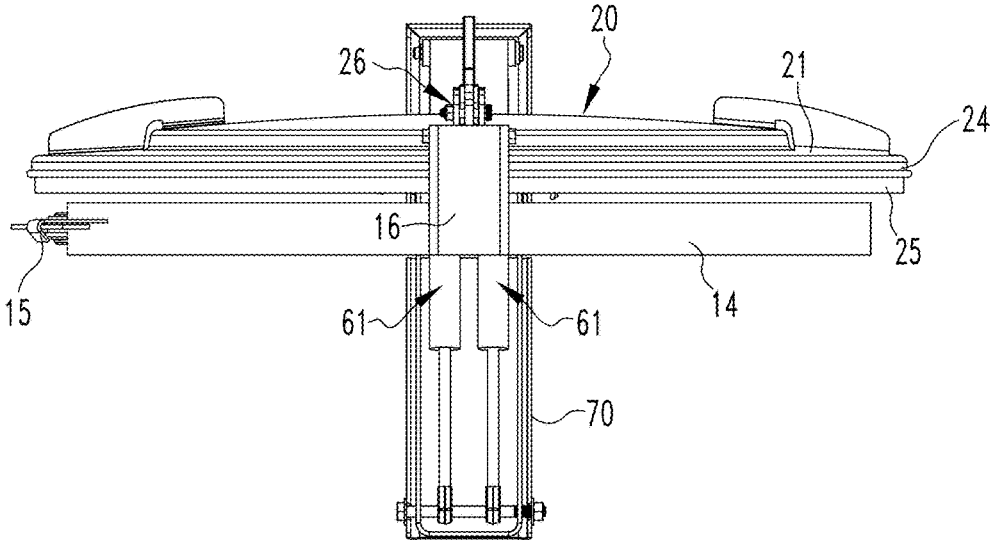
Figure 8:
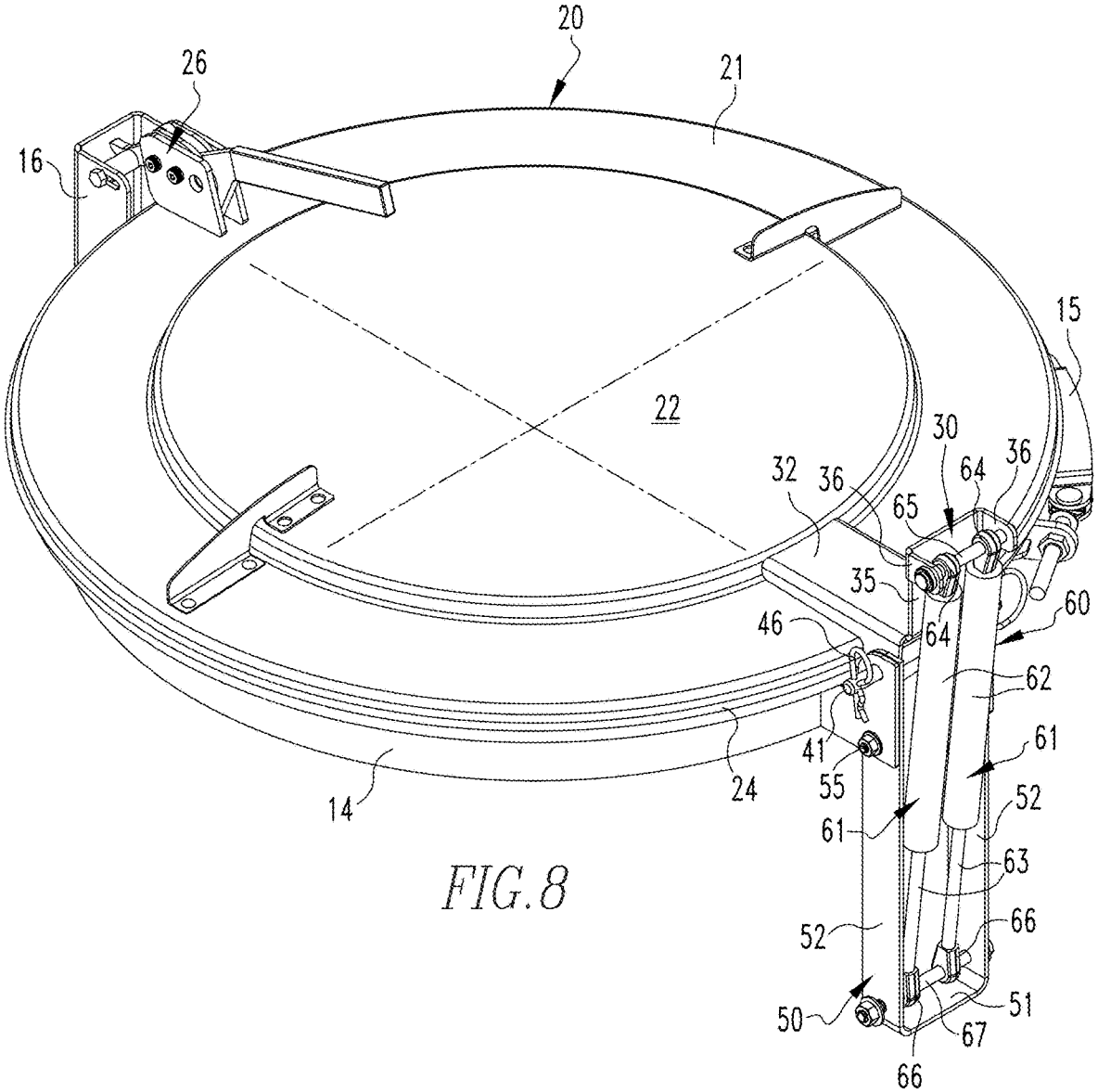
FIGS. 8-11 are are isometric, top, side and front views, respectively, of the self-closing drum lid of FIGS. 1-3, with the cover of the dampening bracket assembly removed.
Figure 9:
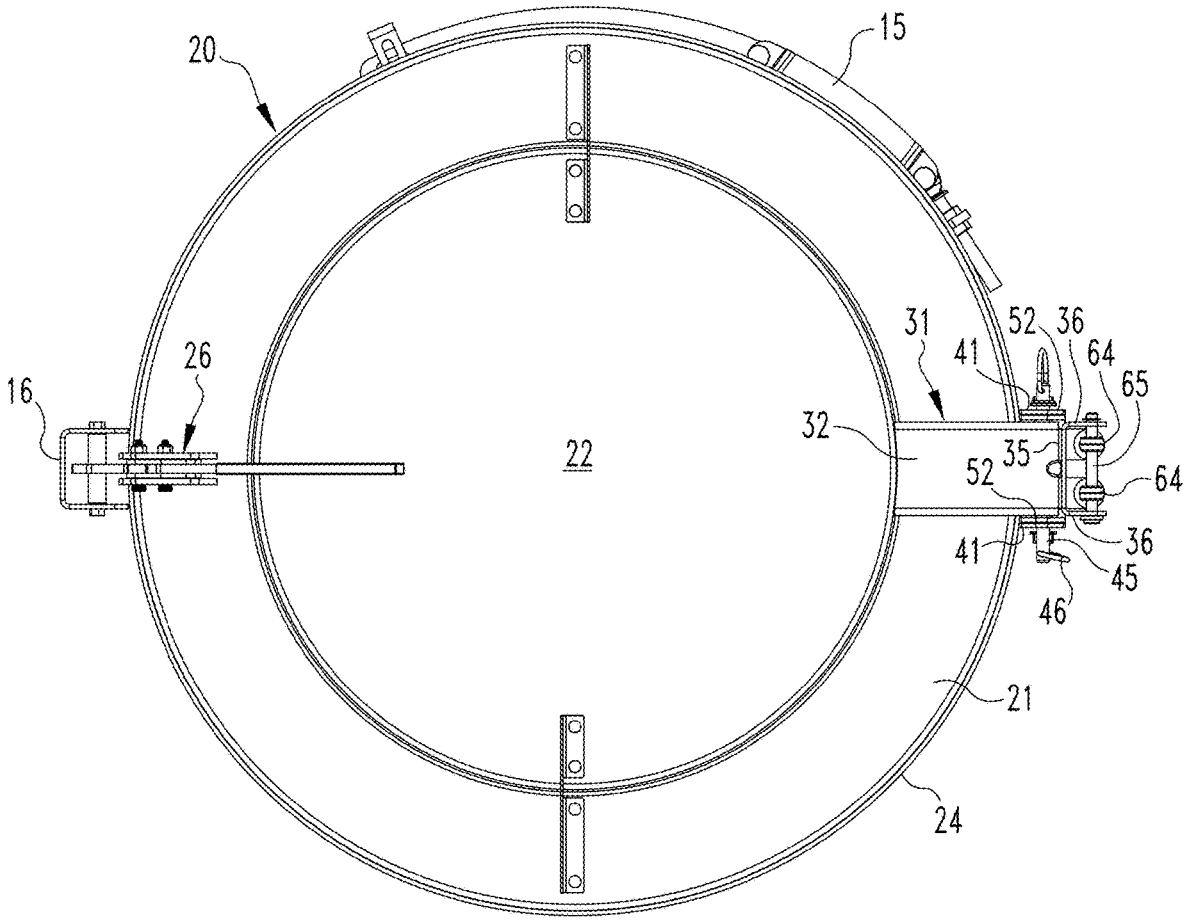

As shown in FIGS. 1-3, a drum assembly 10 includes a drum 12 and a self-closing drum lid 20 of the present invention. A drum band 14 is installed near the upper rim of the drum 12 and includes a conventional adjustment mechanism 15 to tighten and secure the drum band 14. The drum band tightening mechanism may be a bolt or a lever and spring system, for example, as described in U.S. Pat. No. 8,480,139, which is incorporated herein by reference. A drum band latch 16 with a latch keeper rod 17 is secured to the drum band 14 at the front of the drum 12. A self-closing dampening bracket assembly 30 is secured to the drum band 14 at the rear of the drum 12. A latch assembly 26 including a latch 27 and handle 28 is secured to the self-closing drum lid 20. As shown in FIGS. 2 and 3, when the self-closing drum lid 20 is in a closed position, the latch assembly 26 may be used to secure the self-closing drum lid 20 to the drum 12 by engagement between the latch 27 and the latch keeper rod 17. The handle 28 may be used to disengage the latch assembly 26 when the self-closing drum lid 20 is opened.

As shown in FIGS. 1-12, the self-closing drum lid 20 includes a top 21 with a raised central portion 22, a bottom 23, an outer rim 24, and a lower annular seal 25. The generally disk-shaped drum lid 20 may be made of any suitable materials such as steel or other metals, polymers, composites, or the like. The annular seal 25 may be used to provide a vapor seal when the drum lid 20 is closed. Any suitable material may be used for the annular seal 25 such as foamed polymers, e.g., polyethylene, or the like.

As further shown in FIGS. 1-12, the self-closing dampening bracket assembly 30 includes a lid bracket 31 with a radial arm 32, vertical extension tabs 33, bracket pivot holes 34, an upwardly extending vertical arm 35, radial extension tabs 36 and dampener piston pivot holes 37. The radial arm 32 of the lid bracket 31 is secured to the top 21 of the drum lid 20. In the embodiment shown, the radial arm 32 extends inward and contacts the raised central portion 22 of the top 21. The radial arm 32 extends radially outward beyond the outer rim 24 of the drum lid 20 to the upwardly extending vertical arm 35, which extends vertically upward when the self-closing drum lid 20 is closed. As more fully described below, the radial extension tabs 36 of the lid bracket 31 receive an upper pivot pin 65 of a dampener piston assembly 60 in the dampener piston pivot holes 37 to thereby form an upper dampener pivot point $P_{DU}$. In FIGS. 1-7, the self-closing dampening bracket assembly 30 is partially enclosed in a bracket assembly cover 70.

As most clearly shown in FIGS. 8-12, a drum band bracket 41 includes opposing radial arms 42 secured to the rear of the drum band 14, vertical arms 43, pivot holes 44, and bracket attachment holes 48. As more fully described below, the pivot holes 44 of the drum band bracket 41 and the bracket pivot holes 34 of the lid bracket 31 are aligned with each other and receive a pivot pin 45 that defines a lid pivot point $P_L$. A cotter pin 46 is used to secure the pivot pin 45 in place.

The self-closing dampening bracket assembly 30 also includes a generally U-shaped dampener bracket 50 having a base 51 and vertical arms 52. Upper dampener attachment pivot holes 53 are provided in the vertical arms 52, and bracket attachment holes 54 are provided below the upper pivot holes 53. Lower dampener attachment pivot holes 57 are provided through the vertical arms 52 adjacent to the bottom base 51 of the dampener bracket 50. Attachment bolts 55 extend through the bracket attachment holes 54, and through the bracket attachment holes 48 in the radial arms 42 of the drum band bracket 41, to secure the dampener bracket 50 in a fixed position in relation to the drum band bracket 41.

As shown in FIGS. 8-12, the dampener piston assembly 60 includes two dampener pistons 61. Although two dampener pistons 61 are shown, any other suitable number of dampener pistons may be used. Each dampener piston 61 includes a piston cylinder 62, piston rod 63, upper pivot end 64, and lower pivot end 66. The upper pivot ends 64 of the dampener pistons 61 include holes that receive an upper pivot pin 65, which also extends through the dampener piston pivot holes 37 of the lid bracket 31. The lower pivot ends 66 include holes that receive a lower pivot pin 67, which also extends through the lower dampener attachment pivot holes 57 of the dampener bracket 50.

Figure 10:
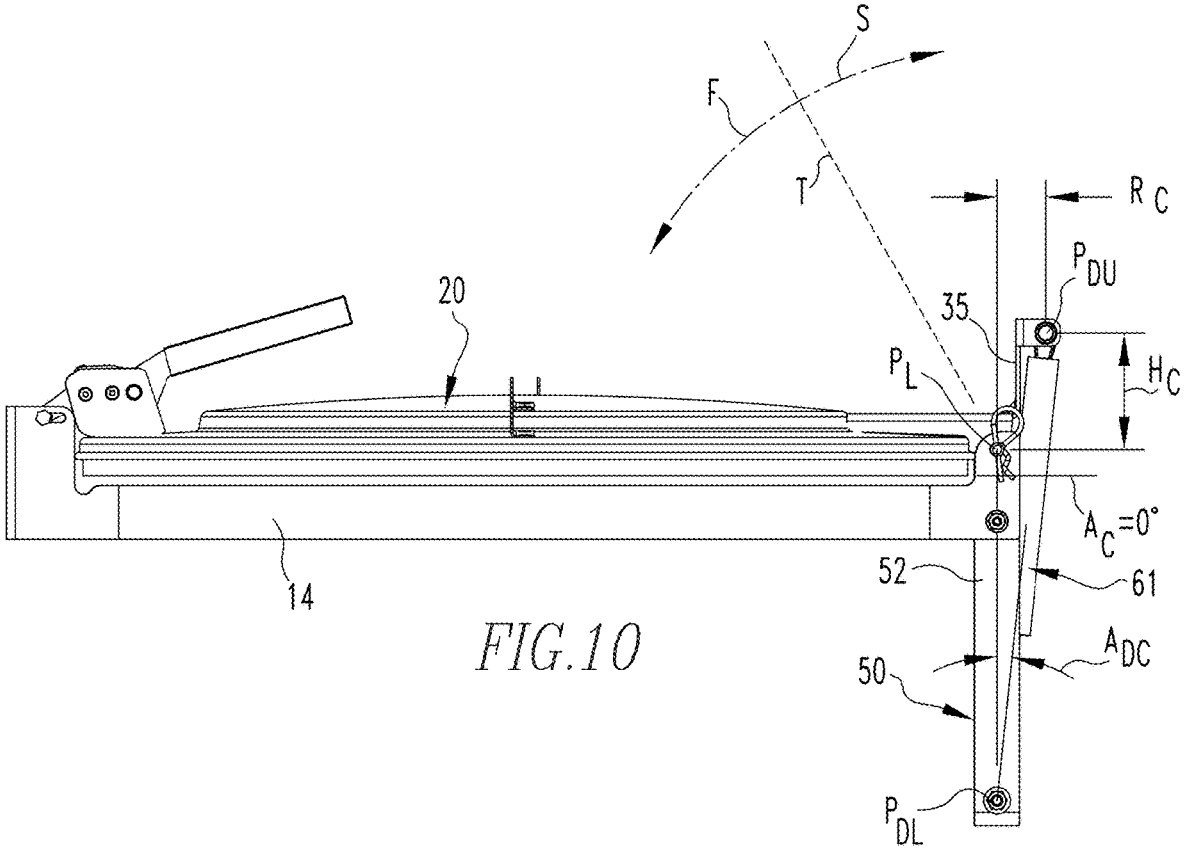
Figure 11:
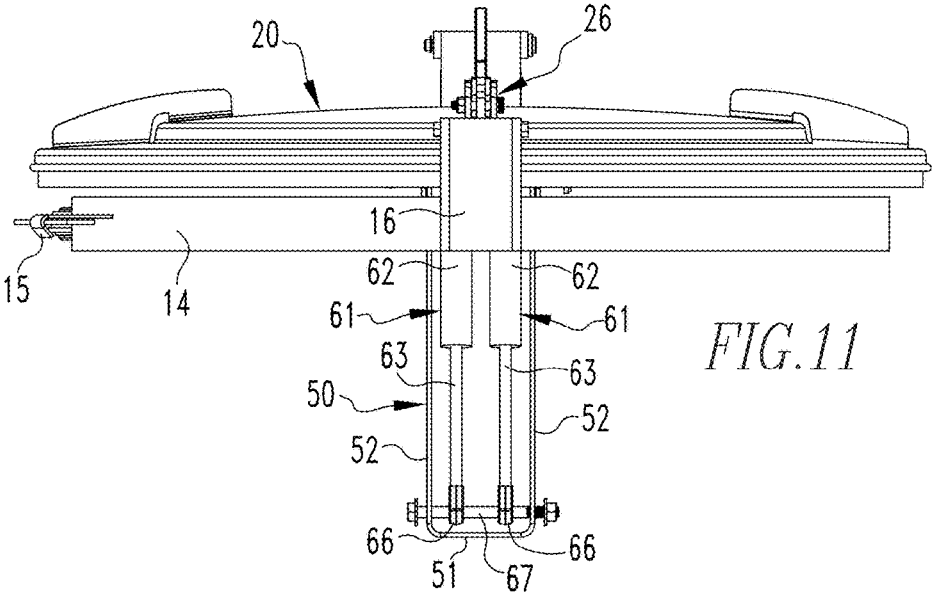
Figure 12:
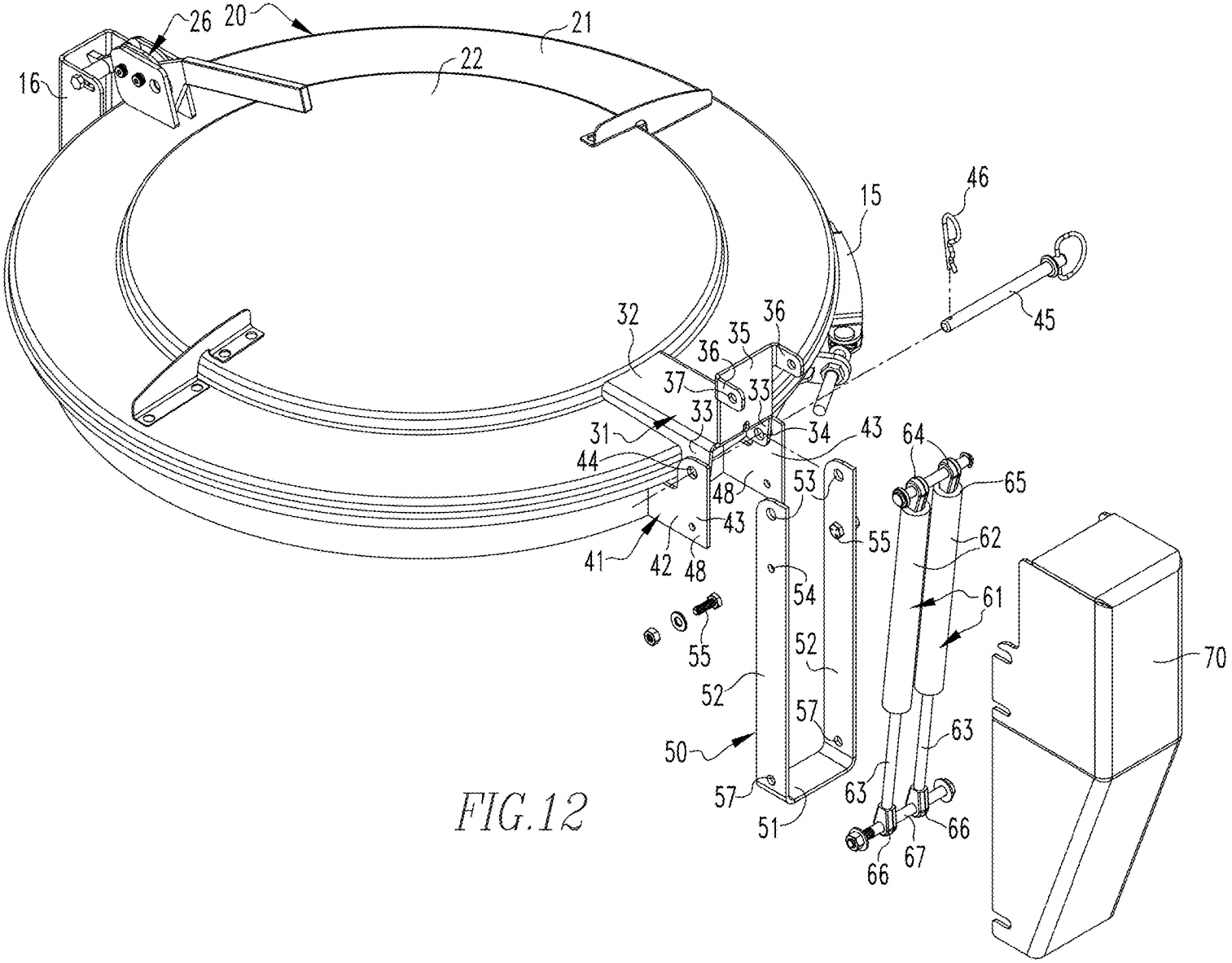
FIG. 12 is an exploded isometric view showing component parts of the self-closing drum lid.
Figure 13:
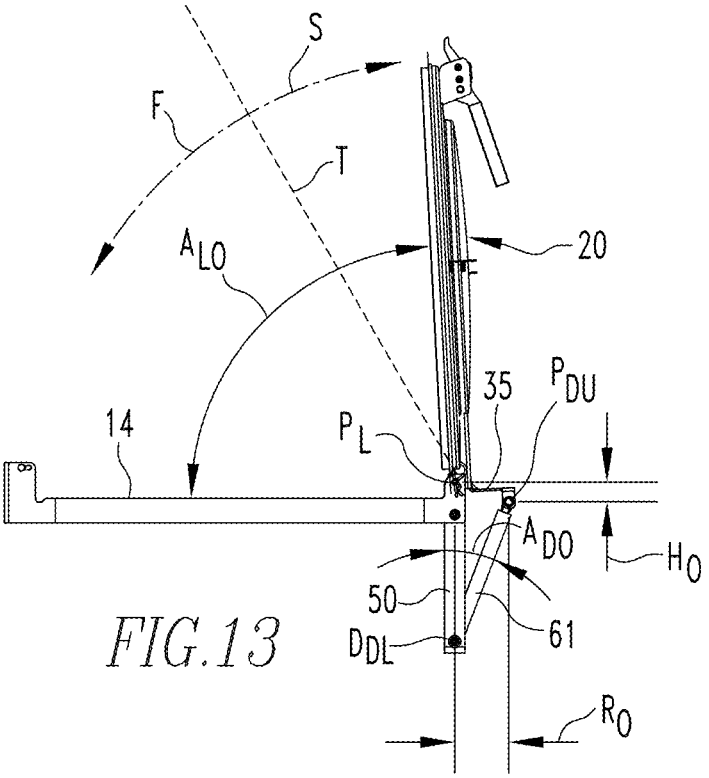
FIGS. 13-21 are sequential side views showing various positions of the self-closing drum lid moving from an open position toward a closed position, including a schematic illustration of a transition from relatively slow closing rates to relatively fast closing rates during self-closing of the lid.
Figure 14:
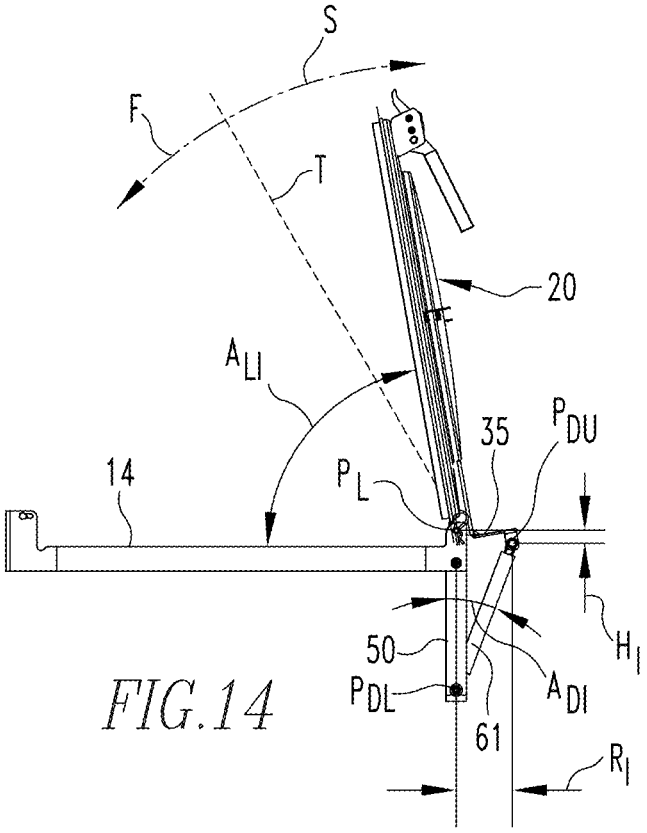
Figure 15:
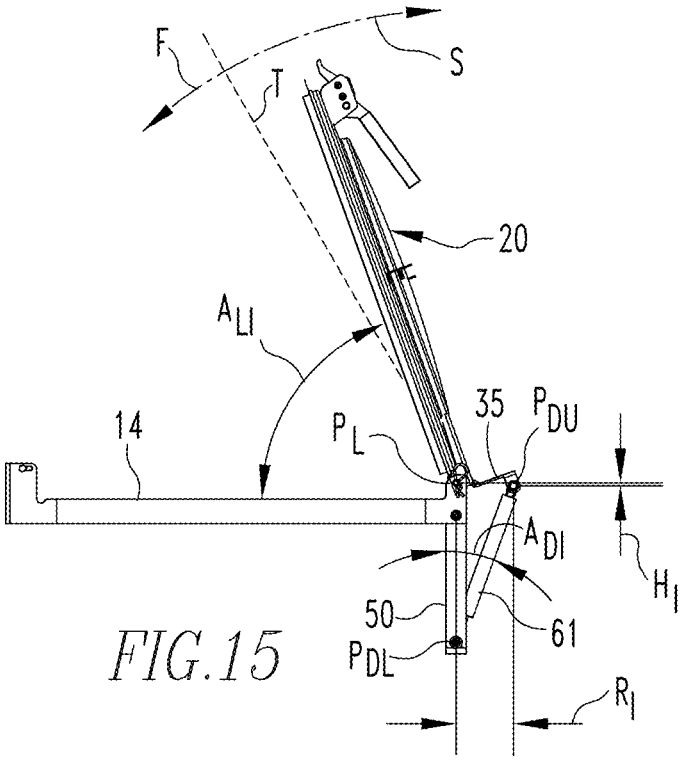
Figure 16:
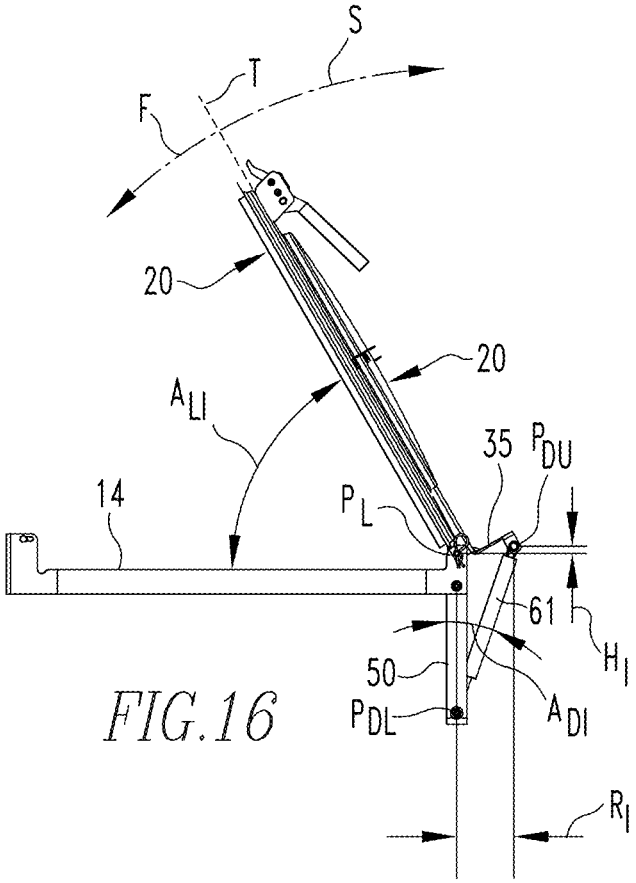
Figure 17:
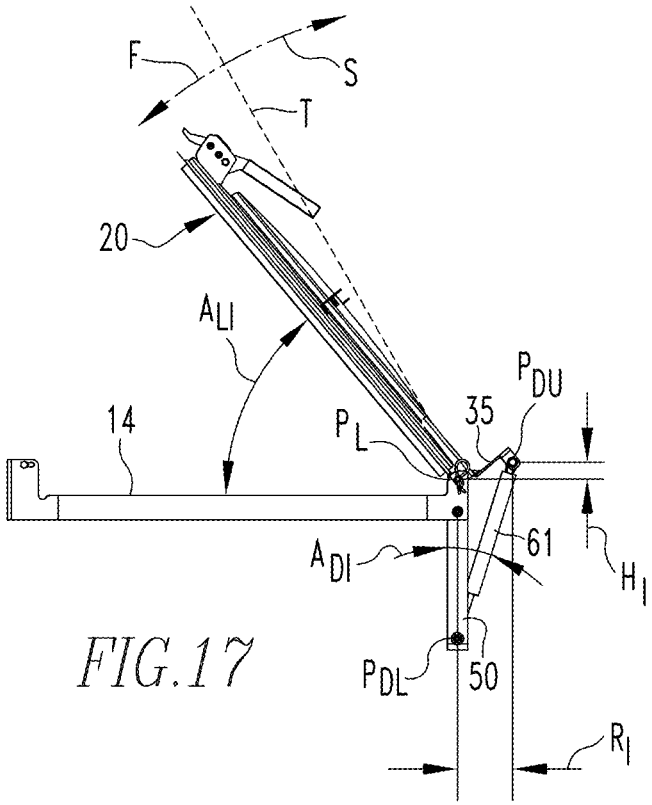
Figure 18:
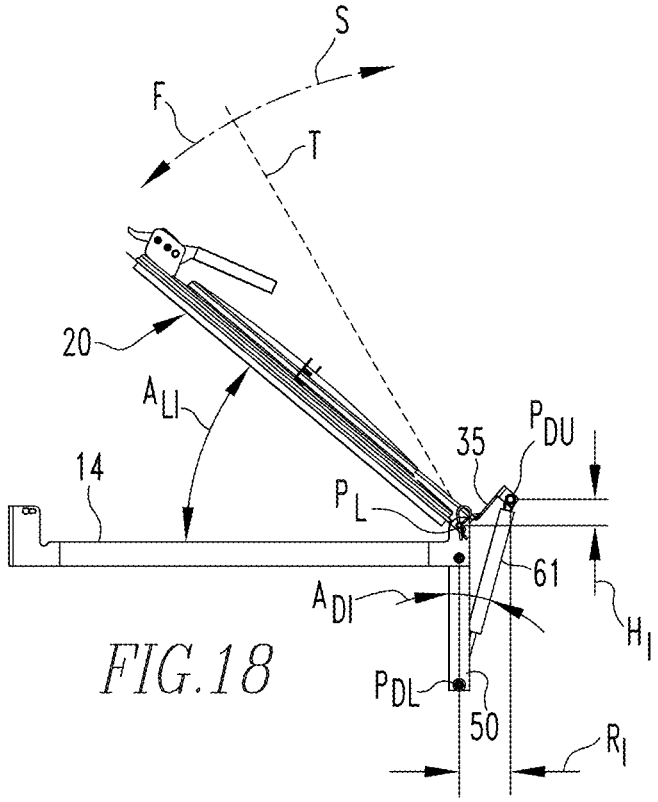
Figure 19:
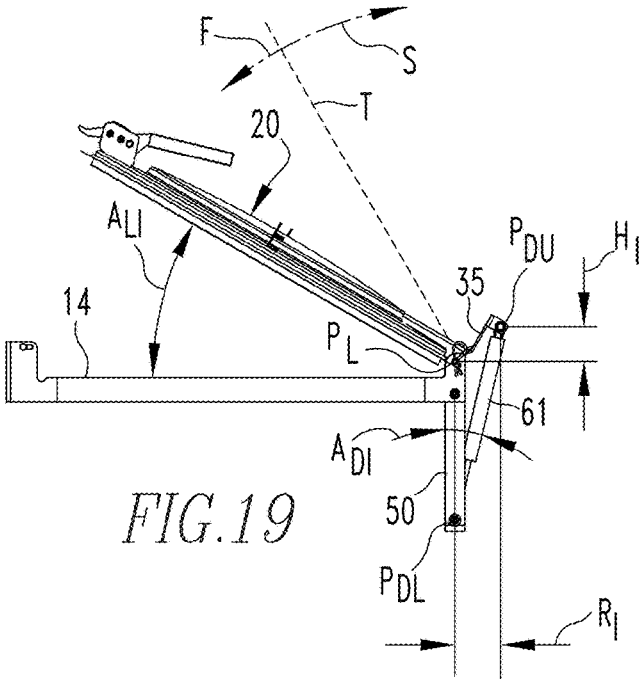
Figure 20:
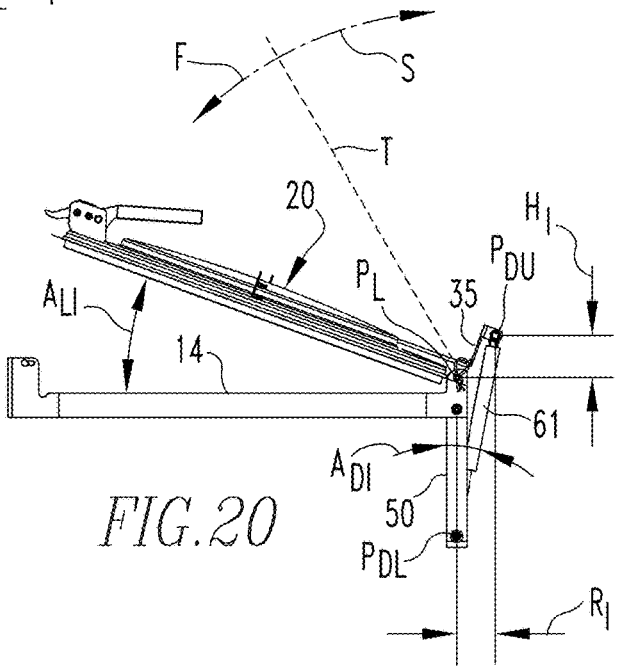
Figure 21:
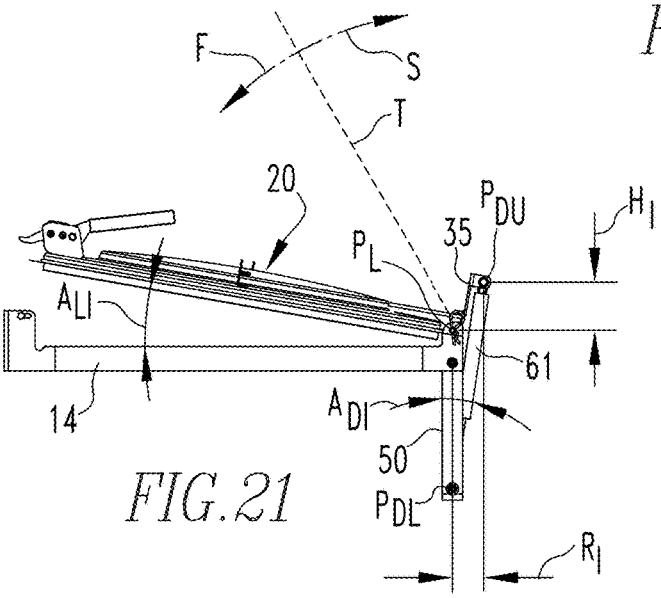

FIG. 10 is a side view of the self-closing drum lid 20 in a closed position. FIG. 13 is a side view of the self-closing drum lid 20 in a fully open position. FIGS. 14-21 are side views illustrating the self-closing drum lid 20 in sequential positions as the drum lid 20 automatically closes from the open position shown in FIG. 13 to the closed position shown in FIG. 10. The figures illustrate a lid pivot point $P_L$, upper dampener pivot points $P_{DU}$ and a lower dampener pivot point $P_{DL}$. During self-closing of the drum lid 20, the lid pivot point $P_L$ and lower dampener pivot point $P_{DL}$ remain in their respective positions, while the upper dampener pivot points $P_{DU}$ move during closing operations.

As further shown in FIGS. 10 and 13-21, a drum lid angle $A_L$ is measured between a plane defined by the drum band 14 and a plane defined by the bottom 23 of the self-closing drum lid 20. In the closed position shown in FIG. 10, the drum lid angle $A_L$ corresponds to a closed drum lid angle $A_{LC}$ equal to zero degrees. In the open position shown in FIG. 13, the drum lid angle $A_L$ corresponds to an open drum lid angle $A_{LO}$ which may be less than 90°, for example, from 85° to 89°, or about 88°. The open drum lid angle $A_{LO}$ may be established by the fully retracted positions of the piston rods 63 in their respective piston cylinders 62 as shown in FIG. 13. Alternatively, or in addition to, the use of the dampener pistons 61 to control the open drum lid angle $A_{LO}$, a mechanical stop (not shown) may be used to prevent the open drum lid 20 from going past a 90° drum lid angle. In FIGS. 14-21, as the self-closing drum lid 20 travels from the open position shown in FIG. 13 to the closed position shown in FIG. 10, the drum lid angle $A_L$ corresponds to intermediate drum lid angles $A_{LI}$.

As further shown in FIGS. 10 and 13-21, a transition angle T may be defined as an angle or range of angles separating a slow closing rate zone S in which the self-closing drum lid 20 travels at a relatively low rate or speed, and a fast closing rate zone F in which the self-closing drum lid 20 travels at an increased rate or speed in comparison with the slow closing rate zone S. The transition angle T in FIGS. 10 and 13-21 is measured from the plane of the drum band 14 and is 60° in the embodiment shown. However, the transition angle T may be within a range from 45° to 85°, or from 50° to 80°, or from 55° to 75°.

In certain embodiments, the self-closing drum lid 20 may initially travel from the open drum lid angle $A_{LO}$ at a faster rate than the slow closing rate S in an initial closing zone in which the at least one dampener piston assembly applies substantially no resistive force against rotation of the lid. In this manner, the self-closing drum lid 20 may initially move from the open drum lid angle $A_{LO}$, e.g., approximately 88°, with little or no resistance in the initial closing zone. The initial low-resistance closing zone may be from 1° to 30° measured from the open drum lid angle $A_{LO}$, for example, from 2° to 20°.

As further shown in FIGS. 10 and 13-21, a radial offset distance R is defined between the lid pivot point $P_L$ and the varying upper dampener pivot points $P_{DU}$. In FIG. 10, the radial offset distance corresponds to a closed radial offset distance $R_C$. In FIG. 13, the radial offset distance R corresponds to an open radial offset distance $R_O$. In FIGS. 14-21, the radial offset distance R corresponds to varying intermediate radial offset distances $R_I$.

As further shown in FIGS. 10 and 13-21, a height offset distance H is provided between the lid pivot point $P_L$ and the varying upper dampener pivot points $P_{DU}$. In FIG. 10, the height offset distance H corresponds to a closed height offset distance $H_C$. In FIG. 13, the height offset distance H corresponds to an open height offset distance $H_O$. In the intermediate positions shown in FIGS. 14-21, the height offset distance H corresponds to varying intermediate height offset distances $H_I$.

As shown in FIGS. 10 and 13-21, a dampener piston angle $A_D$ is defined between the vertical dampener bracket 50 and the dampener pistons 61. In FIG. 10, the dampener piston angle $A_D$ corresponds to a closed dampener piston angle $A_{DC}$. In FIG. 13, the dampener piston angle $A_D$ corresponds to a open dampener piston angle $A_{DO}$. In the intermediate positions shown in FIGS. 14-21, the dampener piston angle $A_D$ corresponds to varying intermediate dampener piston angles $A_{DI}$.

In accordance with the present invention, the configuration of the dampening bracket assembly 30 and dampener piston assembly 60, in combination with the center of mass of the drum lid 20 in relation to its pivot point $P_L$, are selected to achieve the variable closing rates described above as the self-closing drum lid 20 moves from its open position to its closed position. The arrangement and dimensions of the components of the brackets, such as the radial offset distance R between the lid pivot point $P_L$ and the upper dampener pivot point $P_{DV}$, and the height offset distance H between $P_L$ and $P_{DU}$, may be selected to control the closing rates of the drum lid, based upon first order lever mechanics.

The self-closing drum lid provides several advantages. Unless forced by the user, the system is in the closing or closed mode because of the gravity force upon the lid mass and the fact that the lid open angle is less 90° from horizontal. Once material is added or removed from the container, the user may walk away with confidence the lid will close, saving time. The soft-close feature adds safety to the user helping to prevent fingers from becoming pinched or impacted between the lid and the drum rim. The lid helps users comply with environmental regulations that require waste containers to be closed at all times except when adding or removing material from the container.

As used herein, "including," "containing" and like terms are understood in the context of this application to be synonymous with "comprising" and are therefore open-ended and do not exclude the presence of additional undescribed or unrecited elements, material or method steps. As used herein, "consisting of" is understood in the context of this application to exclude the presence of any unspecified element, material or method step. As used herein, "consisting essentially of" is understood in the context of this application to include the specified elements, materials or method steps, where applicable, and to also include any unspecified elements, materials or method steps that do not materially affect the basic or novel characteristics of the invention.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A self-closing drum lid comprising:

a drum lid;

a dampening bracket assembly attached to the lid comprising:

a lid bracket including a radial arm extending radially outward from an outer rim of the drum lid and an upwardly extending vertical arm integrally formed with the radial arm and extending upward from the radial arm;

a dampener bracket pivotally attached to the lid bracket extending downward from the radial arm including at least one downwardly extending vertical arm and a base adjacent a bottom end of the at least one downwardly extending vertical arm; and a dampener piston assembly comprising at least one dampener piston having an upper end pivotally attached to the upwardly extending vertical arm of the lid bracket and a lower end pivotally attached adjacent to the base of the dampener bracket.

2. The self-closing drum lid of claim 1, wherein the radial arm extends in a direction parallel with a plane of the drum lid.

3. The self-closing drum lid of claim 1, wherein the radial arm extends over a portion of an upper surface of the drum lid.

4. The self-closing drum lid of claim 1, wherein the upwardly extending vertical arm extends in a direction perpendicular to a plane of the drum lid.

5. The self-closing drum lid of claim 1, wherein the dampener bracket comprises two of the downwardly extending vertical arms connected to the base to form a generally U-shape.

6. The self-closing drum lid of claim 1, wherein the upper end of the at least one dampener piston is attached to at least one radial extension tab extending radially outward from an upper end of the upwardly extending vertical arm.

7. The self-closing drum lid of claim 1, wherein the dampener piston assembly comprises two of the dampener pistons.

8. The self-closing drum lid of claim 1, wherein each dampener piston comprises a piston cylinder receiving a piston rod.

9. The self-closing drum lid of claim 8, wherein the piston rod is extended from the piston cylinder when the drum lid is in a closed position, and is retracted into the piston cylinder when the drum lid is in an open position.

10. The self-closing drum lid of claim 1, wherein the lid bracket comprises at least one downwardly extending vertical extension tab extending downward from the radial arm, and an upper portion of the at least one downwardly extending vertical arm of the dampener bracket is pivotally connected to the at least one downwardly extending vertical extension tab.

11. The self-closing drum lid of claim 10, further comprising a drum band bracket pivotally connected to the at least one downwardly extending vertical extension tab of the lid bracket, and fixedly connected to the at least one downwardly extending vertical arm of the dampener bracket.

12. The self-closing drum lid of claim 1, further comprising:

a drum band structured and arranged for mounting on a drum; and a drum band bracket attached to the drum band, wherein the drum lid is pivotally attached to the drum band bracket, and the dampener bracket is fixedly attached to the drum band bracket comprising at least one vertical arm pivotally connected to the radial arm of the lid bracket.

13. The self-closing drum lid of claim 12, wherein at least one vertical arm of the drum band bracket is fixedly connected to the at least one downwardly extending vertical arm of the dampener bracket.

14. The self-closing drum lid of claim 12, wherein the drum lid is pivotally attached to at least one vertical arm of the drum band bracket.

15. The self-closing drum lid of claim 1, wherein the dampening bracket assembly and the dampener piston assembly are structured and arranged to allow the drum lid to automatically close from a fully open position in which a plane of the drum lid defines an open drum lid angle $A_{LO}$ of less than 90° measured from a horizontal plane to a closed position in which the plane of the drum lid defines a closed drum lid angle $A_{LC}$.

16. The self-closing drum lid of claim 15, wherein the open drum lid angle $A_{LO}$ is from 85° to 89°.

17. The self-closing drum lid of claim 15, wherein the closed drum lid angle $A_{LC}$ is zero degrees measured from the horizontal plane.

18. The self-closing drum lid of claim 15, wherein the drum lid travels through a transition angle T between the fully open and closed positions above which the lid closes at a relatively slow closing rate S, and below which the lid closes at a relatively fast closing rate F higher than the relatively slow closing rate S.

19. The self-closing drum lid of claim 18, wherein the transition angle T is from 45° to 85°.

20. The self-closing drum lid of claim 18, wherein the transition angle T is from 55° to 75°.

21. The self-closing drum lid of claim 18, wherein the drum lid initially travels from the open drum lid angle $A_{LO}$ at a faster rate than the slow closing rate S in an initial closing zone in which the at least one dampener piston assembly applies substantially no resistive force against rotation of the lid.

22. The self-closing drum lid of claim 21, wherein the initial closing zone is from 1° to 30° measured from the open drum lid angle $A_{LO}$.

23. The self-closing drum lid of claim 22, wherein the initial closing zone is from 2° to 20°.

24. A drum assembly comprising:

a drum;

a drum band attached to the drum comprising a drum band bracket; and a self-closing drum lid pivotally connected to the drum band bracket comprising:

a drum lid;

a dampening bracket assembly attached to the lid comprising:

a lid bracket including a radial arm extending radially outward from an outer rim of the drum lid and an upwardly extending vertical arm integrally formed with the radial arm and extending upward from the radial arm;

a dampener bracket pivotally attached to the lid bracket and fixedly attached to the drum band bracket extending downward from the radial arm including at least one downwardly extending vertical arm and a base adjacent a bottom end of the at least one downwardly extending vertical arm; and a dampener piston assembly comprising at least one dampener piston having an upper end pivotally attached to the upwardly extending vertical arm of the lid bracket and a lower end pivotally attached adjacent to the base of the dampener bracket.

25. A self-closing drum lid comprising:

a drum lid;

a dampening bracket assembly attached to the lid comprising:

a lid bracket including a radial arm extending radially outward from an outer rim of the drum lid and an upwardly extending vertical arm extending upward from the radial arm;

a dampener bracket pivotally attached to the lid bracket extending downward from the radial arm including at least one downwardly extending vertical arm and a base adjacent a bottom end of the at least one downwardly extending vertical arm, wherein the lid bracket comprises at least one downwardly extending vertical extension tab extending downward from the radial arm, and an upper portion of the at least one downwardly extending vertical arm of the dampener bracket is pivotally connected to the at least one downwardly extending vertical extension tab;

a dampener piston assembly comprising at least one dampener piston having an upper end pivotally attached to the upwardly extending vertical arm of the lid bracket and a lower end pivotally attached adjacent to the base of the dampener bracket; and a drum band bracket pivotally connected to the at least one downwardly extending vertical extension tab of the lid bracket, and fixedly connected to the at least one downwardly extending vertical arm of the dampener bracket.

* * * * *